United States Patent [19]

Engbers

[11] 4,269,082

[45] May 26, 1981

[54] RESETTING DEVICE FOR THE CAM HEAD ON A DEEP-WELL PUMP DRIVE

[75] Inventor: Hermann Engbers, Hoogstede OT Tinholt, Fed. Rep. of Germany

[73] Assignee: Wintershall Aktiengesellschaft, Kassel, Fed. Rep. of Germany

[21] Appl. No.: 49,785

[22] Filed: Jun. 18, 1979

[30] Foreign Application Priority Data

Jun. 27, 1978 [DE] Fed. Rep. of Germany ..... 2828110

[51] Int. Cl.[3] ..... G05G 1/04

[52] U.S. Cl. ..... 74/522

[58] Field of Search ..... 74/522, 519

[56] References Cited

U.S. PATENT DOCUMENTS

| | | | |
|---|---|---|---|
| 3,965,772 | 6/1976 | Hamisch | 74/522 |
| 4,034,623 | 7/1977 | Boone et al. | 74/522 |

*Primary Examiner*—Patrick D. Lawson

*Attorney, Agent, or Firm*—Haseltine and Lake

[57] ABSTRACT

A device for displacing the walking beam of deep-well pump drives. The walking beam support of the pivot bearing has on its long sides guides for the walking beam, while its narrow sides have slide arrangements for slightly raising and supporting the walking beam during lengthwise displacement. A two-way shifting device is hinged to the pivot bearing. The other end of the shifting device is connected to that part of the walking beam which engages the crank. On both long sides of the walking beam support, a guide rail may protrude beyond the contact plane of the walking beam support and enclose the lower part of the walking beam. The narrow sides of the walking beam support may mount rollers whose axes run parallel to the narrow sides of the walking beam support. The bottom side of the walking beam has arc-shaped recesses for receiving the roller parts protruding beyond the contact area of the walking beam support. The center axes of these recesses are parallel to the rotary axes of the rollers. The shifting device may be a two-way hydraulic drive whose cylinder is fastened to the pivot bearing block while the piston rod is connected to the walking beam.

4 Claims, 2 Drawing Figures

RESETTING DEVICE FOR THE CAM HEAD ON A DEEP-WELL PUMP DRIVE

BACKGROUND OF THE INVENTION

In order to lift up liquids deposited in the ground, for example petroleum, frequent use is made of deep well pumps whose cylinder with foot valve is connected to the tubing and installed in the borehole. The pump piston of such a deep well pump is suspended from a sucker-rod string which is kept in periodic up and down motions by means of a deep-well pump drive above ground.

The oil field pumping unit drive consists of a support framework on which the walking beam is pivoted by means of a rocker bearing. One end of the walking beam is connected to a crank assembly which moves this end of the walking beam up and down. This motion is transferred by the walking beam to the pump linkage which is fastened by means of the wireline hanger to the horse head which is mounted on the free end of the walking beam. The curve track of the horse head is laid out so that the suspension cable unrolling on it is always vertically above the center of the borehole.

For inspection of the tubing pump it is occasionally necessary to remove the wireline hanger and the well tubing connected with the oil well tubing pump. To perform this work, the horse head must be removed from the walking beam or displaced along it so far that the hoisting equipment of the disassembly device workover rig can travel vertically up and down above the borehole. For this purpose, it is necessary that a maintenance man climbs onto the walking beam from a ladder and moves astride the beam unit; reaching the horse head in order to loosen its locking arrangement. When installing the horse head, the same procedure must be used.

Since this type of disassembly and assembly of the horse head involves considerable hazard, attempts have been made to eliminate this hazard, and accordingly it is an object of the present invention to provide for improvements in eliminating the hazard.

Another object of the present invention is to provide an arrangement, of the foregoing character, which is substantially simple in construction and may be economically fabricated.

A further object of the present invention is to provide an arrangement, as described, which may be readily maintained in service and which has a substantially long operating life.

SUMMARY OF THE INVENTION

To achieve the objects of the present invention, a device for shifting the walking beam of sucker rod pumping units drives has been found. The walking beam support of the pivot bearing (center bearing) at its long sides is equipped with guide means for the walking beam, while its narrow sides have sliding arrangements which slightly raise and support the walking beam during lengthwise shifting. A two-way shifting device is hinged to the pivot center bearing base plate . The other end of this shifting device is hinged to that portion of the walking beam which is engaged by the crank assembly.

The guide means may be several freely rotating guide rollers which are located on the long sides of the walking beam support of the pivot bearing. The axes of these rollers are perpendicular to the contact plane of the walking beam support and the roller bed areas contact the side surfaces of the walking beam bottom portion. However, good results have been obtained with guide rails which are arranged on the two long sides of the walking beam support and enclose the bottom portion of the walking beam. The enclosing portion of such a guide rail must be shaped so that it permits a slight raising of the walking beam.

Both narrow sides of the walking beam support of the pivot bearing must have sliding arrangements which slightly raise and support the walking beam during lengthwise shifting. It is advantageous to have on the two narrow sides of the walking beam support roller bearings whose axes run parallel to the narrow sides of the walking beam support and whose upper roller bed area is slightly above the support area of the walking beam support. It is important to provide arclike recesses in the bottom side of the walking beam bottom portion. These recesses correspond and cooperate with these guide rollers. In the normal position of the walking beam, these arc-like recesses are to receive the roller portions which protrude beyond the contact area of the walking beam support. For this purpose, the center axes of these arclike recesses must run parallel to the rotary axes of the rollers.

The shifting gear of the device in accordance with the present invention must be two-way and may have the form of a rack and pinion. Good results have been obtained with a two-way hydraulic drive whose cylinder is fastened to the pivot bearing base plate while its piston rod is connected to the walking beam.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
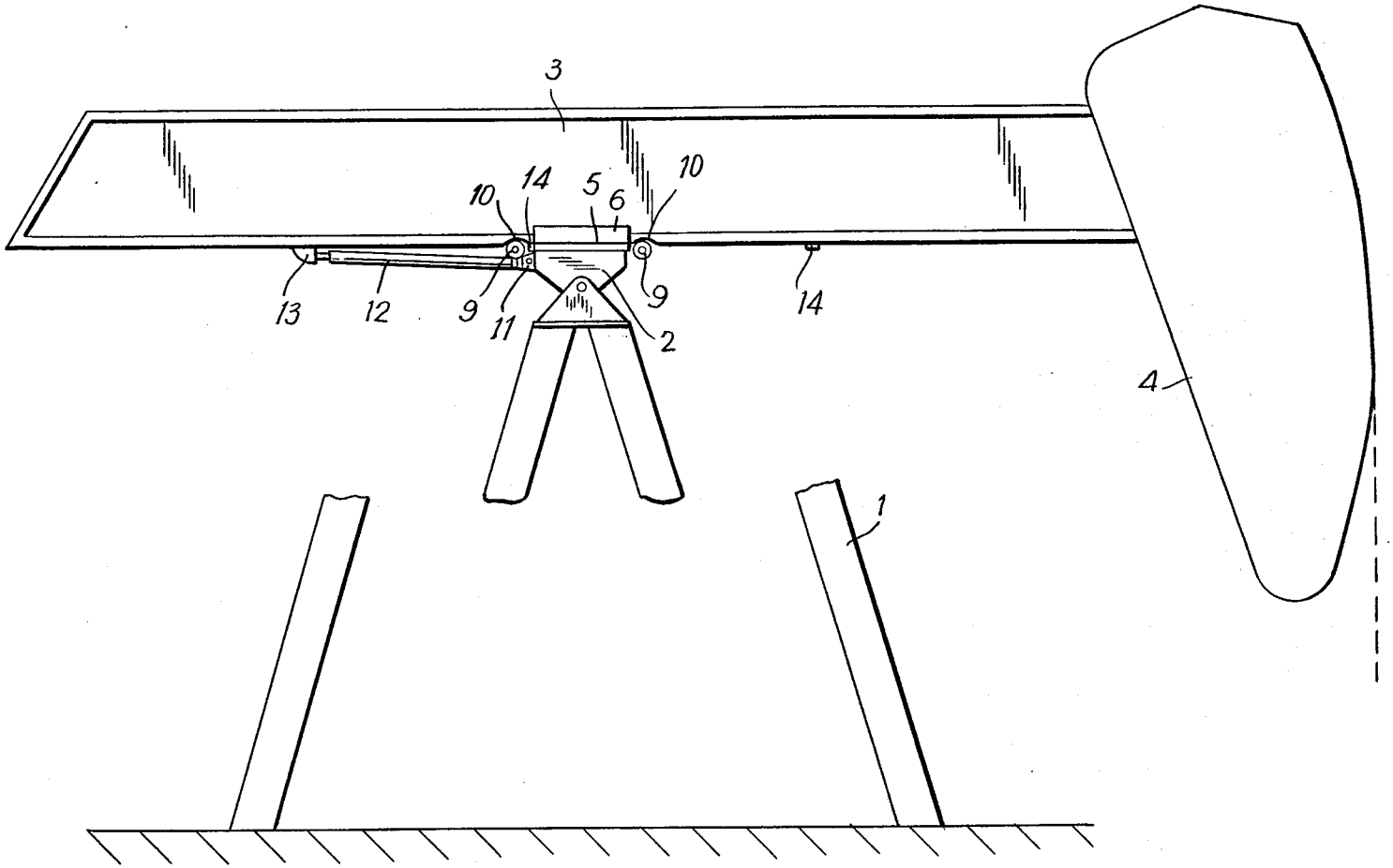
FIG. 1 shows a side view of the device in accordance with the present invention.
Figure 2:
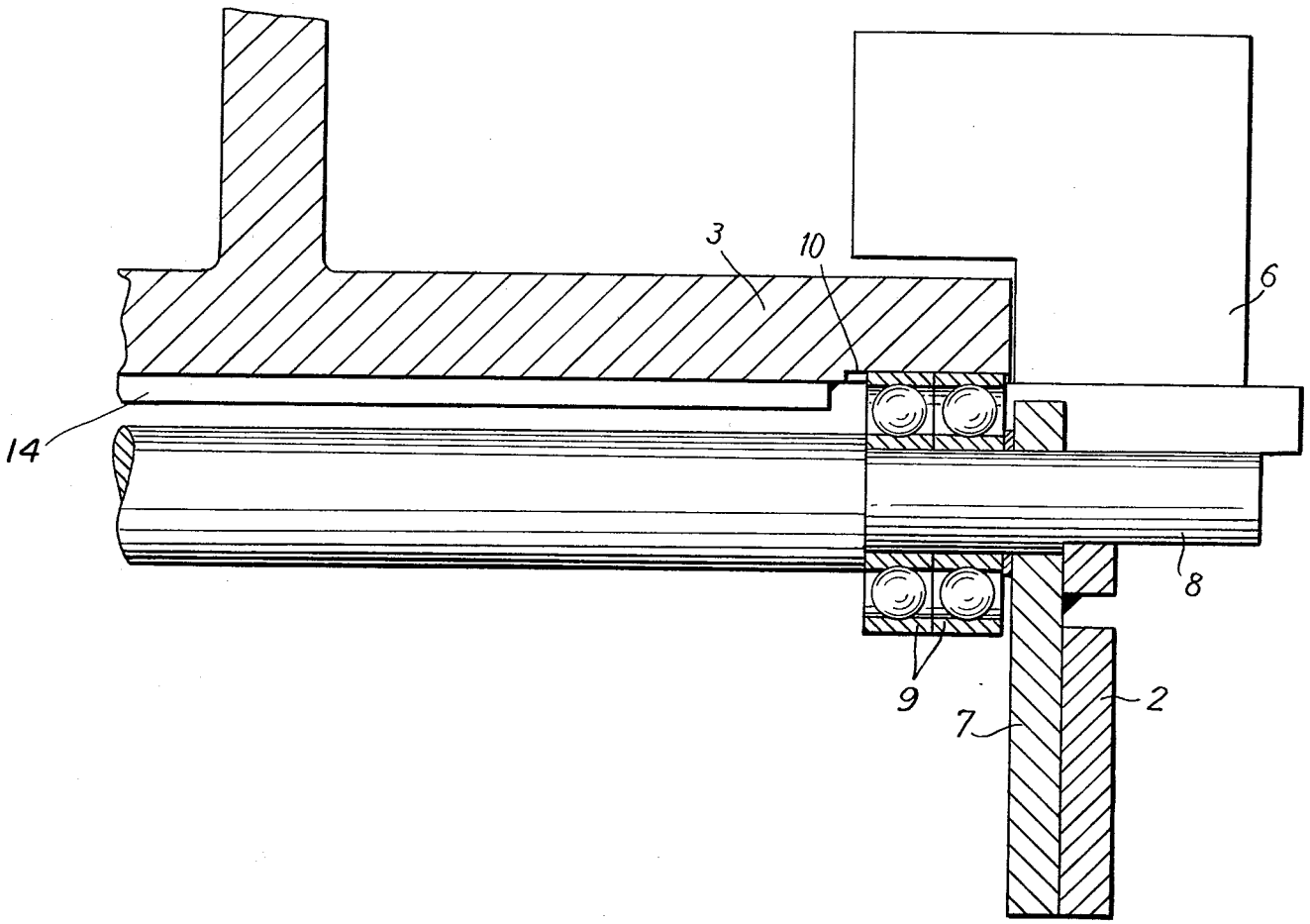
FIG. 2 shows a cross section through the device.

FIG. 1 shows framework 1 of a deep-well pump drive with pivot bearing 2, walking beam 3 and cam-shaped member or horse head 4. On the long sides of the walking beam support 5 of pivot bearing 2 are guide rails 6 which enclose the bottom flange of the walking beam 3 in such a way that the walking beam can be slightly raised. On the narrow sides of the walking beam support 5 are axis supports 7 which carry the axes 8 of sliding rollers 9. Recesses 10 corresponding to the sliding rollers 9 are provided in the lower flange of walking beam 3. Their shape is adapted to the outside shape of sliding rollers 9.

The pivot bearing 2 also mounts the mounting support 11 to which a two-way hydraulic drive 12 is connected. Its piston rod is connected via nose 13 with that part of the walking beam 3 engaged by the crank drive of the deep well pump (not shown). Also, there are stops 14 for restricting the lengthwise shift of the walking beam 3.

To actuate the device of the present invention, liquid is forced via a hydraulic pump (not shown) into the cylinder of the hydraulic drive 12 and the piston rod acting on the cap 13 is pushed out of the hydraulic cylinder. Through this action of hydraulic drive 12, the walking beam 3 is displaced in the lengthwise direction. As a result, the recesses 10 in the lower flange of the walking beam are displaced relative to sliding rollers 9. Hence the walking beam is slid with the lower surface of its lower flange onto rollers 9 and rolls on them with little resistance, pulled by the action of hydraulic drive 12, till the forward stops 14 make contact. In this position the walking beam 3 is removed so far from the borehole that the space above the borehole may be used for hoisting equipment and other devices. After finishing the work, the walking beam 3 may be moved back to the initial position.

Thus the device of the present invention makes it possible to clear the space above the borehole without removing the horse head so that other equipment may be placed there. In particular, the hazards involved in the disassembly and reassembly of the counterpoise are eliminated.

Without further analysis the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A device for displacing the walking beam of deep-well pump drives comprising: a pivot bearing having a walking beam support; guide means for said walking beam; said walking beam support having long sides and narrow sides; sliding arrangements located on said narrow sides for slightly raising and supporting said walking beam during lengthwise displacement; a two way-shifting device hinged to said pivot bearing, a crank assembly; said two-way shifting device having another end connected to a part of said walking beam engaging said crank assembly.

2. A device as defined in claim 1 including one guide rail on each of said long sides of said walking beam support, said guide rail protruding beyond contact plane of said walking beam support and enclosing a lower portion of said walking beam.

3. A device as defined in claim 1 including rollers on said narrow sides of said walking beam support, said rollers having axes running parallel to said narrow sides of said walking beam support; said rollers having an upper roller bed area located slightly above a contact area of said walking beam support; arc-shaped recesses in bottom side of said walking beam for receiving in normal position of said walking beam parts of said rollers protruding beyond a contact area of said walking beam support, said recesses having center axes parallel to rotary axis of said rollers.

4. A device as defined in claim 1 wherein said two-way shifting device comprises a two-way hydraulic drive having a cylinder fastened to said pivot bearing and a piston rod fastened to said walking beam.

* * * * *